US006050892A

United States Patent [19]

Sodec

[11] Patent Number: 6,050,892

[45] Date of Patent: Apr. 18, 2000

[54] ADJUSTABLE FLOOR-MOUNTED AIR OUTLET VENT

[75] Inventor: Franc Sodec, Wuerselen, Germany

[73] Assignee: Krantz-TKT GmbH, Bergisch Gladbach, Germany

[21] Appl. No.: 09/204,024

[22] Filed: Dec. 1, 1998

[30] Foreign Application Priority Data

Dec. 5, 1997 [DE] Germany ..... 197 53 889

[51] Int. Cl.[7] ..... F24F 13/06

[52] U.S. Cl. ..... 454/289; 23/390; 454/308; 454/310; 454/316

[58] Field of Search ..... 454/289, 290, 454/296, 297, 300, 308, 310, 316; 23/388, 390

[56] References Cited

U.S. PATENT DOCUMENTS 2,955,525 10/1960 Steffner ..... 454/310

FOREIGN PATENT DOCUMENTS 4405867 6/1995 Germany .

5-332601 12/1993 Japan ..... 454/289

OTHER PUBLICATIONS

K. Yokoyama et al.; "The Evaluation of the Newly Developed Underfloor Air–Conditioning System"; *Healthy Buildings* '94, Budapest, Hungary, 1994; 6 pages.

K. Yokoyama et al.; "The Application of the Underfloor Air–Conditioning System"; *Indoor Air* '93 , Helsinki, Finland, 1993; 6 pages.

*Primary Examiner*—Harold Joyce

*Attorney, Agent, or Firm*—W. F. Fasse; W. G. Fasse

[57] ABSTRACT

An air outlet vent (1) adapted to be mounted in a floor (6) and connected to a heating, ventilating and air-conditioning air supply duct (30) includes a cylindrical housing (2) and a cover plate (4) that covers the top open end of the housing (2). The plate (4) includes a first group of air outlet openings in the form of concentric circular arcuate slits (11) extending over a first sector of the plate (4), and a second group of air outlet openings in the form of radially extending slits (12) in a second sector of the plate (4). The plate (4) is rotatably adjustable in the housing (2). With this arrangement, the direction of the main air flow axis of the air flow pattern generated by the vent can be infinitely rotationally adjusted around an imaginary inverted cone, to direct the air flow where desired and avoid undesirable drafts, while still providing a highly turbulent twisting or spiraling air flow characteristic.

20 Claims, 2 Drawing Sheets

FIG.3A
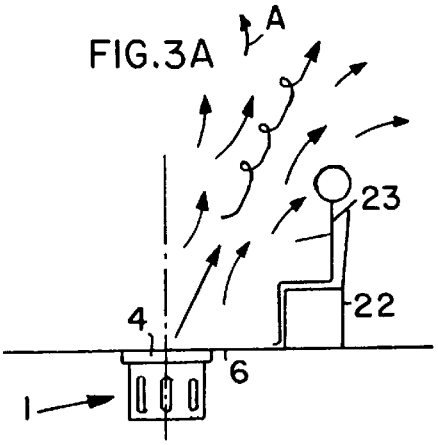
FIG.4A
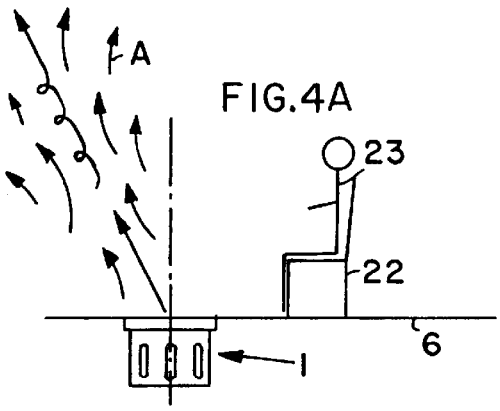
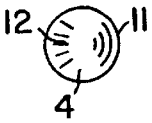
FIG.3B
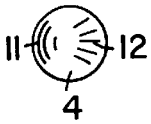
FIG.4B

ADJUSTABLE FLOOR-MOUNTED AIR OUTLET VENT

FIELD OF THE INVENTION

The invention relates to an air outlet vent and particularly an adjustable floor-mounted vent, including a cylindrical housing that has airflow openings therein and that is adapted to be set into a floor opening, and a cover plate having outlet openings therein and covering the top of the housing.

BACKGROUND INFORMATION

Various types of adjustable air outlet vents are known, for example as components of heating, ventilation and air-conditioning (HVAC) systems in residential and commercial buildings. Such air outlet vents may also be used in the HVAC systems of motor vehicles, aircraft, railroad cars, and the like. Such air outlet vents are to provide the desired air flow pattern, volume flow rate, and flow velocity for achieving a comfortable environment for persons occupying the building, vehicle, or the like in which the air outlet vents are installed. It is particularly important that the air outlet vents be adjustable, for adjusting the air distribution pattern, flow rate, and/or flow velocity when the vent is positioned relatively close to a location at which a person will be seated or standing, such as a work station. In these situations, it is important that the air flow characteristics can be adjusted to suit the affected person's preferences while simultaneously providing the required ventilation and heating or cooling.

An adjustable floor-mounted air outlet vent of the above mentioned general type is, for example, disclosed in German Patent 4,405,867. The known air outlet vent according to this German patent achieves the combined and adjustably selectable functions of a flooding source outlet that provides a gentle substantially horizontal flow into the space being ventilated, as well as a spiral or swirl outlet vent that provides a high energy swirling or spiralling vertical air flow into the space being ventilated. To achieve this, the cover plate of the air outlet vent includes two groups of radially elongated air outlet slots or slits, whereby the two groups of slits are respectively arranged on outer and inner concentric circles or partial circles. The two groups of air outlet slits respectively provide the two different air flow patterns described above.

To select the desired air flow pattern, the known air outlet vent further includes a control disk movably or adjustably arranged below the cover plate. Adjusting the height of the control disk partially or completely blocks the flow cross-sections of the air outlet slits belonging to the group arranged on the inner concentric circle, and thereby selectively adjusts the air flow pattern. All of the radially extending air outlet slits of each respective group are uniformly circumferentially distributed and have the same shape and size, and a uniform orientation. Furthermore, all of the slits are bounded by sidewalls that extend at a uniform angle relative to the vertical axis, so that the air emitted through these slits generates a spiralling or swirling air flow. While the known air outlet vent is very effective at incorporating the characteristics of a horizontal flooding flow outlet vent and of a vertical spiralling or swirling outlet vent, as alternatively selectable operating options, it does not allow the primary air flow direction to be adjusted about the central vertical axis of the air outlet vent.

SUMMARY OF THE INVENTION

In view of the above, it is an object of the invention to provide an air outlet vent, and particularly an adjustable floor-mounted air outlet vent, which enables the air blowing direction to be adjusted so that the air flow velocity at any particular location around the air outlet vent can be adjusted without changing the total air flow volume. Furthermore, the air outlet vent aims to provide a fanned-out air flow pattern, of which the primary air flow direction can be selectively adjusted, and which is characterized by a significantly reduced air flow velocity over the air-stream penetration distance into the space being ventilated. The invention further aims to avoid or overcome the disadvantages of the prior art, and to achieve additional advantages, as apparent from the present description.

The above objects have been achieved in an air outlet vent including a cylindrical housing having air entry openings therein and a cover plate covering one open end of the housing and having elongated air outlet openings in the form of slots or slits therein. Particularly according to the invention, the cover plate is arranged on the housing so as to be rotatable relative thereto, and the air outlet slits on one portion of the cover plate are configured as concentric circular arcuate slits, while the air outlet slits on another portion of the cover plate are configured as radially extending slits.

The combination of the above described two types of air outlet slits in a non-symmetrical arrangement relative to the centerpoint of the cover plate, generates an overall air flow pattern having a main air flow axis that does not extend vertically, e.g. along the central axis of the cover plate, but rather extends at a tilted angle relative to the vertical central axis of the cover plate. In this manner, by rotating the cover plate about the vertical central axis, it is very simply possible to rotate the direction of the tilted main air flow axis about the vertical axis. Thereby the main air flow axis describes an inverted cone as the cover plate is rotated. This allows the main air stream to be rotated toward or away from any particular location at which a person may be seated or the like, for example at a work station, so that it is possible to adjust the air flow velocity effective at the work station without changing the total air flow volume or the overall air flow characteristics, such as the turbulence and the fan-out angle, and without needing to relocate the work station relative to the air outlet vent. By rotationally adjusting the cover plate of the air outlet vent as desired, a person seated at the work station or the like can achieve a perceived air flow characteristic ranging from still air to a fresh breeze, as desired. Nonetheless, independently of the rotational position of the cover plate, the overall air flow pattern always includes a highly turbulent spiraling air stream characteristic.

In an especially advantageous embodiment of the air outlet vent according to the invention, the lengthwise extending side walls or web vanes of the circular arcuate slits are oriented with a tilt angle relative to the vertical. In other words, the cross-sectional central axis of each circular arcuate slit, as seen in the air flow direction, tilts away from the central axis of the cover plate of the air outlet vent. With such an embodiment, the air outlet vent achieves a turbulent air flow with a tilted or sloping air stream axis, which further achieves an intensive intermixing with the ambient air in the space being ventilated. An advantageous air flow pattern is achieved when the tilt angle of the lengthwise extending side walls or web vanes bounding the circular arcuate slits relative to the central axis is in the range from 10° to 40°.

Moreover, an advantageous, direction-adjustable air flow pattern is achieved when the respective end walls of all of the circular arcuate slits are respectively tangent to one of two straight lines, and especially radial lines. In other words, the circular arcuate slits extend in a circumferential direction over a sector of a circle bounded between the two radial lines. For achieving the best air flow pattern and the like, the radial lines span a sector angle of 90 to 150°. The other radially extending slits then occupy the remaining circular sector of the cover plate. Such an embodiment also provides an aesthetically pleasing appearance.

In order to achieve the largest air flow cross-sectional area possible, it is advantageous to make the side wall members or web vanes respectively between two neighboring circular arcuate slits narrower than the opening width of the arcuate slits themselves. To achieve a sufficient and uniform air volume flow also through the radial slits, a sufficient number of radial slits are provided and uniformly distributed circumferentially over the respective sector of the cover plate so that the respective centerlines of neighboring radial slits are circumferentially spaced apart from each other by an angle in the range from 10° to 30°. Moreover, the lengths of the radial slits in the radial direction are not uniform, and preferably the radial length of the central one of the slits is the longest, while the radial length of the slits closest to the arcuate slits is the shortest, and the radial slits therebetween have intermediate lengths. This achieves a desirable air flow distribution pattern.

The air outlet vent according to the invention is particularly embodied as a floor vent adapted to be arranged in an opening in a floor surface, so that the cylindrical housing extends into an air supply duct or the like arranged below the floor. The floor-mounted air outlet vent is especially configured for an advantageous installation in a floor provided with a carpet or the like. Namely, the housing includes a collar flange protruding radially outwardly around the entire circumference of the upper end of the cylindrical housing component, and the housing is so dimensioned that it will fit with a friction fit in a hole provided in the floor, or the housing includes at least one clamping member, such as a bottom clamping ring or a laterally effective spreading member, for actively clamping the housing into the floor opening. In this manner, the protruding collar flange of the housing is slightly pressed down into the carpet, i.e. whereby the carpet is compressed, so that the upper surface of the air outlet vent lies substantially flush with the finished surface of the floor and the air vent does not form a tripping hazard.

The air outlet vent can further include a dirt collector basket having air entry openings in the side wall thereof, below the portion of the housing that is received in the floor and supporting the cover plate. In this manner, any dirt particles or the like that may fall down into the air outlet slits in the cover plate are collected in the basket, so that they do not fall into the air supply duct or other hollow space located directly below the air outlet vent.

BRIEF DESCRIPTION OF THE DRAWINGS

In order that the invention may be clearly understood, it will now be described in connection with an example embodiment, with reference to the accompanying drawings, wherein:

FIG. 3A is a schematic side view of the air flow pattern generated by the inventive air outlet vent with the cover plate in a first position;

FIG. 3B is a schematic top plan view of the cover plate in the first position generating the air flow pattern shown in FIG. 3A;

FIG. 4A is a schematic view similar to that of FIG. 3A, but showing an air flow pattern generated by the inventive air outlet vent with the cover plate rotated into a second position; and FIG. 4B is a schematic top plan view showing the cover plate in the second position generating the air flow pattern as shown in FIG. 4A.

DETAILED DESCRIPTION OF PREFERRED EXAMPLE EMBODIMENTS AND OF THE BEST MODE OF THE INVENTION

Figure 1:
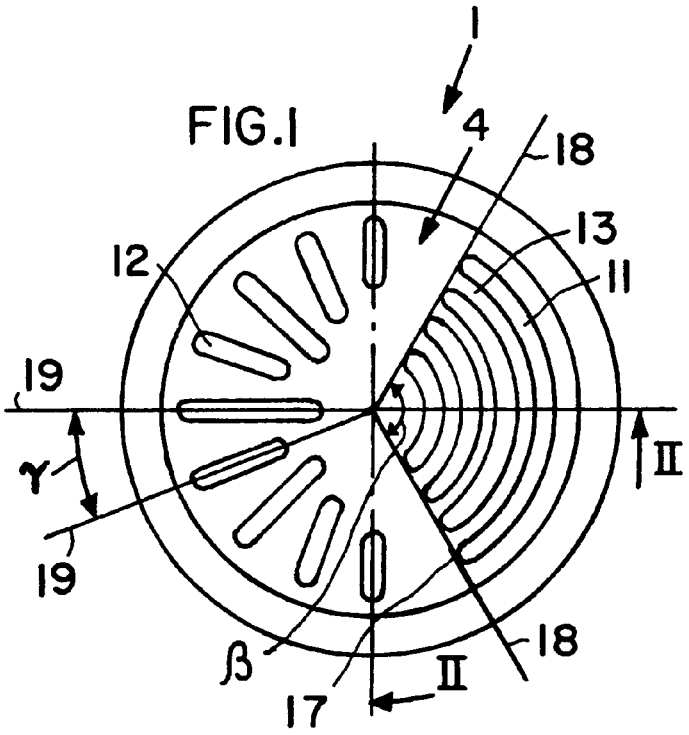
FIG. 1 is a schematic top plan view of a floor-mounted air outlet vent according to the invention.
Figure 2:
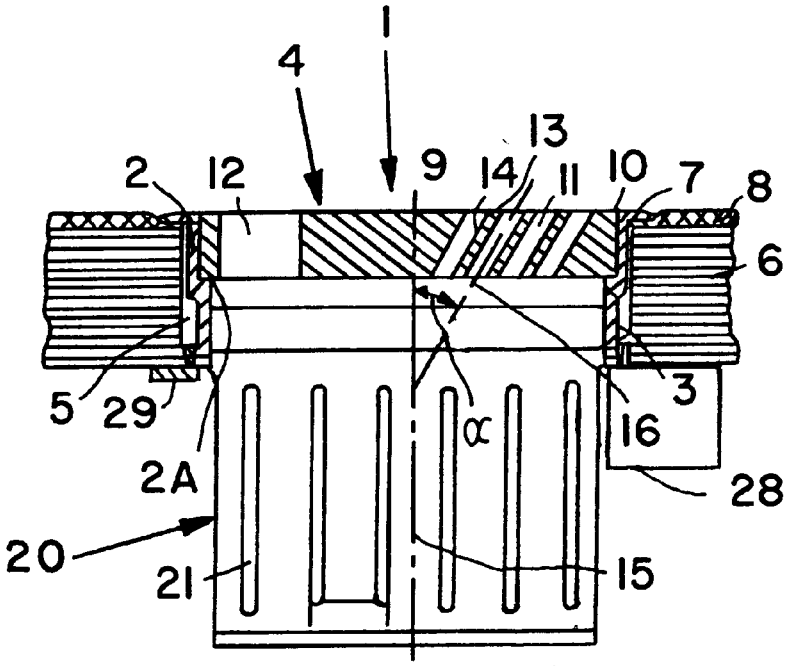
FIG. 2 is a vertical section through the air outlet vent according to the invention, taken along the section line II—II in FIG. 1.

FIGS. 1 and 2 show an air outlet vent 1 adapted to be installed in an opening 5 in a floor 6, so as to provide an air distribution outlet communicating with an air supply duct 30 or the like located below the floor 6. The air outlet vent 1 comprises a substantially cylindrical housing 2 that has an open upper end and an open lower end, and a substantially cylindrical distributor basket 3 extending from the open lower end of the cylindrical housing 2. The phrase "substantially cylindrical" means generally rotationally symmetrical and rotationally uniform about the central axis 15 of the housing, while allowing for steps, shoulders, protrusions, threadings and other deviations from a perfect cylinder bounded by geometrically perfect inner and outer cylindrical surfaces.

To hold the air outlet vent 1 in the fitting opening 5 in the floor 6, the housing 2 further includes a radially protruding collar flange 7 extending circumferentially around open upper end of the cylindrical component of the housing. This protruding collar flange 7 rests on a carpet 8 provided on the floor 6.

Especially due to the resilience of the pile of the carpet 8, the collar flange 7 presses slightly into the carpet 8 so that the upper surface 9 of the plate 4, as well as the upper edge 10 of the housing 2, and the upper surface of the carpet 8 will all be flush with one another. In this manner, a tripping hazard is avoided.

To securely hold the air outlet vent 1 in the opening 5, the opening may be dimensioned properly to achieve a friction press-fit of the cylindrical housing 2 in the opening 5. Alternatively, the housing 2 may further be equipped with a clamping member (shown schematically as 29), such as a threaded clamping ring that clampingly presses against the bottom surface of the floor 6, or a lateral clamping wedge that presses clampingly against the side walls of the opening 5 in the floor 6. Any known clamping device 29 may be used.

The air outlet vent 1 further comprises a cylindrical or circular cover plate 4 that is supported and received in an upper portion of the housing 2, so as to cover the upper open end of the housing 2. For this purpose, the housing 2 has an internal shoulder rim 2A, which supportingly receives the lower rim or edges of the plate 4. The plate 4 is thereby easily rotatable relative to the housing 2, about the central housing axis 15. The plate 4 may be loosely, i.e. removably, received in the cylindrical housing 2, or may be retained in the housing 2, while still being rotatable, for example by a snap ring or spring ring or the like.

The plate 4 has two different circumferential sectors with different air vent openings therein. Namely, as shown in FIGS. 1 and 2, the right side sector is provided with four concentric circular arcuate slits 11, and the remaining left side sector is provided with a total of nine radially extending slits 12. The thickness of each side wall member or web vane 13 respectively between and bounding two adjacent circular arcuate slits 11 is smaller than the radial width of the arcuate slits themselves, in order to achieve the largest possible air flow cross-sectional area.

As shown especially in FIG. 2, the lengthwise side walls 14 of the circular arcuate slits 11 have a frusto-conical configuration. In other words, the side walls 14 are tilted or sloped outwardly relative to the central axis 15 of the air outlet vent 1, which is oriented vertically in this example. In this context, the cross-sectional central axis 16 of each respective circular arcuate slit 11, as seen in the air flow direction, tilts away from the central axis 15. This conical tilt angle $\alpha$ of the side walls 14 relative to the central axis 15 amounts to 30° in the illustrated example.

As shown especially in FIG. 1, the respective end walls 17 at both ends of each circular arcuate slit 11 are tangent to two respective radial lines 18 that intersect the central axis 15 of the air outlet vent 1. The two radial lines 18 enclose a sector angle $\beta$ of 120° therebetween. These end walls 17 each have a rounded shape.

FIG. 1 further shows that the respective centerlines 19 of neighboring radial slits 12 respectively enclose a circumferential spacing angle $\gamma$ of 22.5° therebetween. Thus, the nine radially extending slits 12 are uniformly circumferentially distributed over 180°, while there is a circumferential sector space of 30° without any openings provided on each side between the last or end radial slit 12 and the circular arcuate slits 11. Moreover, the radial slits 12 respectively have different radial lengths, whereby the last radial slits 12 closest to the circular arcuate slits 11 have the shortest radial length, and the centermost one of the radial slits 12 has the greatest radial length. This achieves the most desirable air flow distribution pattern, and also achieves the maximum air flow cross-sectional area while still avoiding a collision of the radial slits with one another in the central area of the plate 4.

FIG. 2 shows a further optional feature of the inventive arrangement, whereby the floor-mounted air outlet vent 1 is equipped with a dirt collector basket 20 extending downwardly from the cylindrical housing 2. The dirt collector basket 20 has a solid closed floor, and a vertical cylindrical side wall with slit-shaped air entry openings 21 extending in a vertical direction therein. The dirt collector basket 20 protrudes below the floor 6 into the air supply channel 30 or the like. This basket 20 serves to catch any dirt particles that might fall down into the air outlet vent 1, so that these dirt particles do not contaminate and accumulate in the air supply duct 30.

The plate 4 is manually rotatable within the cylindrical housing 2 as described above. As a further alternative, the air outlet vent according to the invention can include a servo-motor drive 28 or any other known actuator device, shown schematically in FIG. 2, for rotationally adjusting the position of the plate 4 in an automatic or motorized manner. To achieve this, the servo-motor drive 28 is connected to the plate 4, for example by a drive gear engaging gear teeth provided on the plate 4, or in any other known manner.

The rotational orientation of the plate 4 can be adjusted as desired, to achieve the preferred main air flow direction, and the preferred air flow characteristic at any given location, as will be described next. FIGS. 3A, 3B, 4A and 4B schematically illustrate the air flow pattern and main air flow direction achieved by the inventive air outlet vent 1 with the plate 4 in two different rotational positions. FIGS. 3B and 4B show two different adjusted rotational positions of the plate 4, while FIGS. 3A and 4A respectively show the resulting main air flow direction of the air flow pattern A corresponding to the two different positions of the plate 4.

If a person 23 seated at a work station 22 or the like finds the room temperature to be too high or the air flow or air movement to be too low, then the plate 4 of the air outlet vent 1 installed in the floor 6 near the work station 22 should be rotated into the position shown in FIG. 3B so as to generate the air flow pattern A directed as shown in FIG. 3A. In this condition, the circular arcuate slits 11 are positioned on the right side facing generally toward the person 23. As a result, the turbulent air stream generated by the air outlet vent 1 is also directed upward toward the right, namely generally in a direction toward the person 23 seated at the work station 22. As a result of this direction of the air flow A, the person 23 will feel a fresh breeze with a cooler apparent temperature and a feeling of fresh air circulation.

On the other hand, if the person 23 seated at the work station 22 does not wish to directly feel any motion or flow of air, even though the proper air exchange and total air flow must be maintained, then the plate 4 of the air outlet vent 1 is to be rotated by 180° relative to the position shown in FIG. 3B, to place the plate 4 into the position shown in FIG. 4B. In this position, the circular arcuate slits 11 are directed toward the left, while the radial slits 12 are on the right side. This directs the generated air flow A generally upwardly and toward the left as shown in FIG. 4A. With such an air flow orientation, the person 23 seated at the work station 22 barely notices any air movement generated by the air outlet vent 1, even though the air flow A creates a constant circulation of the room air so as to avoid undesirable stagnation of the air.

While FIGS. 3B and 4B show two particular rotational positions of the plate 4, it should be understood that the rotational position of the plate 4 can be infinitely or steplessly adjusted to any desired position around a full circle. In this manner, the air outlet vent 1 can direct the main axis of the air flow pattern A into any direction as desired, so as to achieve the desired adjusted air flow velocities at the work station 22, without having to move the work station 22. Thereby, the main air flow axis can be adjusted or repositioned anywhere about an imaginary inverted conical surface, while the air flow pattern A itself expands or fans-out upwardly around the main air flow axis. Thereby, the air flow velocity noticeably drops off with increasing distance from the air outlet vent 1 and with increasing distance away from the main air flow axis. In this manner, a high overall air volume flow rate can be achieved without causing undesirable drafts.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An air outlet vent comprising a housing component that is substantially cylindrical about a housing axis and that has an open end, and a plate arranged to cover said open end and to be rotatable relative to said housing component about said housing axis, wherein said plate has a plurality of concentric arcuate elongated slit openings passing through a first portion of said plate, and a plurality of radial elongated slit openings passing through a second portion of said plate.

2. The air outlet vent according to claim 1, wherein said plate has a circular plan shape, and wherein said first portion is a first circular sector of said plate and said second portion is a second circular sector of said plate complementing said first circular sector to form said circular plan shape.

3. The air outlet vent according to claim 1, wherein said arcuate elongated slit openings are concentric about said housing axis, and each one of said arcuate elongated slit openings respectively has a circular arc shape extending along a part of a respective circle.

4. The air outlet vent according to claim 1, wherein said plate is set into said open end of said housing component such that an outer surface of said plate is flush with an end rim surface of said housing component at said open end.

5. The air outlet vent according to claim 1, wherein said plate includes arcuate web vanes having arcuate side walls respectively between and bounding said arcuate elongated slit openings, and wherein said arcuate side walls are each tilted relative to said housing axis such that each one of said arcuate elongated slit openings has an annular frusto-conical shape tilted at a conical tilt angle ($\alpha$) away from said housing axis as seen in a direction from within said housing and extending through said arcuate elongated slit openings.

6. The air outlet vent according to claim 5, wherein said conical tilt angle ($\alpha$) is in a range from 10° to 40°.

7. The air outlet vent according to claim 1, wherein each one of said arcuate elongated slit openings has respective opposite first and second slit ends, and wherein all of said first slit ends of all of said arcuate elongated slit openings are tangent to a first straight line, and all of said second slit ends of all of said arcuate elongated slit openings are tangent to a second straight line.

8. The air outlet vent according to claim 7, wherein said first and second straight lines are respective first and second radial lines intersecting said housing axis.

9. The air outlet vent according to claim 8, wherein said first and second radial lines are angularly spaced from one another about said housing axis by a sector angle ($\beta$)in a range from 90° to 150°.

10. The air outlet vent according to claim 1, wherein said plate includes arcuate web vanes respectively between and bounding said arcuate elongated slit openings, and each one of said web vanes has a width in a radial direction that is less than a width in a radial direction of each one of said arcuate elongated slit openings.

11. The air outlet vent according to claim 1, wherein each one of said radial elongated slit openings is respectively angularly spaced from a neighboring one of said radial elongated slit openings about said housing axis by a spacing angle ($\gamma$) in a range from 10° to 30°.

12. The air outlet vent according to claim 1, further comprising a collar flange protruding radially from said housing component around said open end.

13. The air outlet vent according to claim 12, wherein said air outlet vent is a floor-mounted air outlet vent, further in combination with a horizontal floor having a floor opening therein, wherein said housing component is received in said floor opening and said collar flange rests on an upper surface of said floor.

14. The air outlet vent according to claim 13, wherein said housing component is so dimensioned and configured relative to said floor opening such that said housing component is held with a friction fit in said floor opening.

15. The air outlet vent according to claim 13, wherein said air outlet vent further includes a clamping member that clampingly holds said housing component against said floor in said floor opening.

16. The air outlet vent according to claim 13, wherein said collar flange is recessed into said floor such that an upper surface of said plate, an upper surface of said collar flange, and an upper surface of said floor are all flush with each other.

17. The air outlet vent according to claim 1, further comprising a dirt collection basket extending from a second end of said housing component opposite said open end, wherein said dirt collection basket includes a basket wall with air entry openings passing therethrough.

18. The air outlet vent according to claim 17, wherein said basket wall is a substantially cylindrical wall, said basket further includes a solid floor plate closing a free end of said basket wall, and said air entry openings are elongated slits extending vertically and parallel to said housing axis.

19. The air outlet vent according to claim 1, further comprising a servo-actuator drive connected to said plate and adapted to selectively rotate said plate relative to said housing component about said housing axis.

20. The air outlet vent according to claim 1, wherein said radial elongated slit openings include a center slit and additional slits arranged symmetrically on opposite sides of said center slit, wherein said center slit has a relatively longest radial length, two endmost ones of said additional slits arranged circumferentially furthest from said central slit each have a relatively shortest radial length, and other ones of said additional slits between said endmost ones and said central slit respectively have radial lengths between said relatively shortest and relatively longest radial lengths.

* * * * *